US010758812B2

(12) United States Patent
Edwards

(10) Patent No.: US 10,758,812 B2
(45) Date of Patent: Sep. 1, 2020

(54) PORTABLE LOTTERY TICKET HOLDER

(71) Applicant: David Edwards, Roseburg, OR (US)

(72) Inventor: David Edwards, Roseburg, OR (US)

( * ) Notice: Subject to any disclaimer, the term of this patent is extended or adjusted under 35 U.S.C. 154(b) by 0 days.

(21) Appl. No.: 15/896,033

(22) Filed: Feb. 13, 2018

(65) Prior Publication Data

US 2019/0247742 A1 Aug. 15, 2019

(51) Int. Cl.
*A63F 3/06* (2006.01)
*A63F 11/00* (2006.01)

(52) U.S. Cl.
CPC ..... *A63F 3/068* (2013.01); *A63F 3/0625* (2013.01); *A63F 3/0695* (2013.01); *A63F 2011/0037* (2013.01)

(58) Field of Classification Search
CPC ..... A63F 3/068; A63F 3/0625; A63F 2011/0037; A63F 3/0665; A63F 3/0695
USPC ..... 206/39, 557–567, 315.1; 40/777, 650, 40/649
See application file for complete search history.

(56) References Cited

U.S. PATENT DOCUMENTS 912,805 A * 2/1909 Sims ..... A45C 11/18 206/39.5
2,588,635 A * 3/1952 Junkin ..... G09F 3/20 40/618
3,965,594 A * 6/1976 Candor ..... A47G 1/06 40/533
5,533,900 A * 7/1996 Volk ..... B43L 13/205 434/408
D595,357 S * 6/2009 Simpson ..... D19/88
9,073,378 B2 7/2015 Segura
2010/0064458 A1* 3/2010 Nelson ..... A63F 3/068 15/111
2011/0127180 A1* 6/2011 Vogias ..... A63F 3/0625 206/232
2011/0315595 A1* 12/2011 Gassick ..... A47G 23/0625 206/557
2013/0008065 A1* 1/2013 Danielson ..... G09F 23/06 40/606.01
2014/0312194 A1* 10/2014 Segura ..... B42F 9/001 248/451
2015/0151193 A1* 6/2015 Sartini ..... A63F 3/068 273/309

* cited by examiner

*Primary Examiner* — Chun Hoi Cheung

(57) ABSTRACT

Portable holders for supporting lottery tickets and the scratching off of coatings therefrom. In some embodiments, the holders may include substantially planar surfaces having top edges, bottom edges, left side edges, and right side edges, the top edges being opposite to the bottom edges, and the left side edges being parallel and opposite to the right side edges; at least one slot and/or notch disposed along the surfaces and configured to hold lottery tickets on the surfaces; and trays attached to the bottom edges of the surfaces and configured to collect particulates there within.

17 Claims, 3 Drawing Sheets

PORTABLE LOTTERY TICKET HOLDER

FIELD

This patent application generally relates to lottery ticket apparatuses, and more specifically to lottery ticket holders having a tray configured to collect coating particulates scratched off of the lottery ticket by a user of the holder.

BACKGROUND

For various reasons, it may be desirable to have a portable surface on which to scratch coatings off of lottery tickets, for example as may be useful to help prevent damaging the ticket with a scratching-edged pen, or the like. Conventional systems for scratching lottery tickets have included containers, podiums, clipboards, etc. However, such systems have not been designed to be simple, lightweight, stackable, or otherwise convenient for on-the-go use. Rather, they have been heavy, bulky, and/or cumbersome to use. For example, U.S. Patent Publication No. 2006/0278540A1 to Schacht, for a Lottery Ticket Scratch Container, teaches "a hinged container, connecting a lid portion to a container base portion" and "gutters within the container base portion." U.S. Pat. No. 5,127,720 to Shultz, for Lottery Ticket Tray, teaches a "surface surrounded by four walls," including a "slidable drawer which serves as the storage compartment." U.S. Pat. No. 5,367,959 to Allen et al., for Lottery Ticket Scrapings Catcher, teaches "a base surface for supporting lottery tickets . . . and a moat surrounding at least a substantial part of the base surface for catching the coatings scraped from the tickets." And, U.S. Patent Publication No. 2010/0007086A1 to Keatts et al., for Scratch Off Lottery Ticket Accessory, teaches a surface including "a planar surface disposed in a well between sidewalls" and "a movable gate and a cup for retaining debris."

Further, the foregoing disclosures have presented surfaces for lottery ticket scratching that have been relatively expensive and complicated to manufacture, including requiring the assembly of multiple components using different materials. Thus, it would be desirable to further reduce manufacturing costs and lead time for the production of surfaces for the scratching of lottery tickets.

SUMMARY

The present teachings disclose a portable lottery ticket holder comprising a substantially planar surface having a perimeter having a top edge, a bottom edge, a left side edge, and a right side edge, wherein the top edge is opposite to the bottom edge, and the left side edge is opposite to the right side edge. The lottery ticket holder also includes at least one slot disposed along the surface and configured to hold a lottery ticket thereon. Additionally, the lottery ticket holder includes a tray attached to the bottom edge of the surface and configured to collect particulates disposed there within. Further, the surface may be configured to support the scratching off of a coating from a lottery ticket disposed on the surface and held there by the at least one slot. In some embodiments, the at least one slot may be disposed along the top edge of the surface. Some embodiments may include only one slot while other embodiments may include two or more slots. For example, the at least one slot may include two slots, a first slot being disposed along the left side edge of the surface, and a second slot being disposed along the right side edge of the surface.

In embodiments having two or more slots, the first slot and the second slot may be configured to enable the lottery ticket to slide longitudinally onto the surface and toward the tray. In such embodiments, a first root of the first slot may be spaced apart from a second root of the second slot at a distance corresponding to a width of the lottery ticket that may be held on the surface. Additionally, in such embodiments, the first slot and the second slot may be disposed substantially parallel with the left side edge and the right side edge of the surface, respectively.

In some embodiments, the surface of the lottery ticket holder may include at least one raised portion on which the at least one slot is disposed. For example, the lottery ticket holder may include two or more raised portions, including a first raised portion on disposed the left side edge of the surface, and a second raised portion disposed on the right side edge of the surface. In such embodiments, the first slot may more specifically be a groove disposed along the left side edge, and the second slot may similarly be a groove disposed along the right side edge. Additionally, in some embodiments, the lottery ticket holder may include at least one high-friction material disposed on the surface and configured to reduce slippage of the lottery ticket on the surface. Additionally or alternatively, the at least one slot of the lottery ticket holder may be at least partially rubberized to thereby reduce slippage of the lottery ticket within the at least one slot.

In some embodiments, the tray may extend upward and away from the surface and inward from the perimeter of the surface. In some embodiments, the tray may be generally U-shaped in cross-section. In other embodiments, however, the tray may be generally V-shaped or L-shaped in cross-section. In some embodiments, the surface, the at least one slot, and the tray of the lottery ticket holder may form one continuous piece composed of substantially the same materials. In some embodiments, lottery ticket holders may be stackable with each other. For example, a first tray of a first lottery ticket holder may be stackable with a second tray of a second lottery ticket holder, such that the first tray fits on top of the second tray.

In some embodiments, at least one notch may be used instead of the at least one slot. That is, the present disclosure also teaches a lottery ticket holder comprising a substantially flat surface having a perimeter including a top edge, a bottom edge, a left side edge, and a right side edge, wherein the top edge is opposite to the bottom edge, and the left side edge is opposite to the right side edge. This lottery ticket holder also includes at least one notch disposed on the surface and configured to hold a lottery ticket on the surface, as well as a tray disposed along the bottom edge of the surface and configured to collect particulates disposed there within. In some embodiments, the at least one notch may include a first notch disposed near the left side edge of the surface and a second notch disposed near the right side edge of the surface. Embodiments having the at least one notch instead of the at least one slot may be otherwise substantially similar. Some embodiments may include both the at least one slot and the at least one notch.

Thus, various aspects of the present disclosure teach a novel approach to lottery ticket holders designed to reduce the complexity, weight, and/or bulkiness that may be associated with conventional lottery ticket scratching surfaces. Features, functions, and advantages of the present disclosure may be achieved independently in various embodiments, or may be combined in yet other embodiments. Further details of the disclosure may be seen in reference to the following Detailed Description and accompanying drawings.

DETAILED DESCRIPTION

Overview

Figure 2:
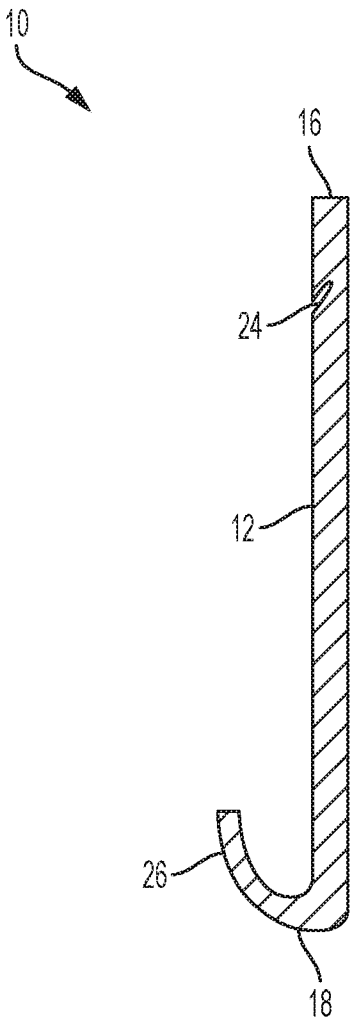
FIG. 2 shows a cross-sectional side view of the lottery ticket holder of FIG. 1, according to aspects of the present disclosure.

The present disclosure contemplates portable lottery ticket holders for enabling scratching of an obscuring coating off of lottery tickets by a user with a scratching device to disclose hidden information on the tickets and that address the problem of conventional holders being relatively heavy, bulky, expensive, cumbersome to use, and/or complicated to manufacture. As disclosed herein, the lottery ticket holders offer a simple, lightweight, convenient, and economical alternative to such conventional systems, while still offering users suitable surfaces for supporting lottery tickets and the scratching off of a coating therefrom, as well as a solution for collecting the scratched-off coatings. The disclosed lottery ticket holders may be manufactured at relatively low costs, and require relatively low lead times to produce. Additionally, the lottery ticket holders are easily pocketable and carried around for use while on-the-go, stowed away in a desk drawer or glove compartment, and/or stacked together to save space. In fact, the slim design and portability of the disclosed lottery ticket holders may even offer significant opportunities for lottery ticket retailers to sell the holders along with lottery tickets, such as by making the holders available for purchase at lottery ticket vending kiosks.

Various aspects of the present disclosure are described below and illustrated in the associated drawings, using certain embodiments and examples intended to illustrate but not limit the disclosure. Additionally, certain aspects of the disclosure may be described as a "first", a "second," a "third," and so forth. However, this numbering scheme is not intended to limit the disclosure to only the numbers described herein, nor to imply that any particular sequence or number of elements are necessary to the disclosure. The subject matter of the present invention is particularly pointed out and distinctly claimed representing the scope of the invention in the concluding portion of this specification. However, both the organization and method of operation, together with further advantages and objects thereof, may best be understood by reference to the following descriptions taken in connection with accompanying drawings wherein like reference characters refer to like elements.

Examples, Components, and Alternatives

Figure 1:
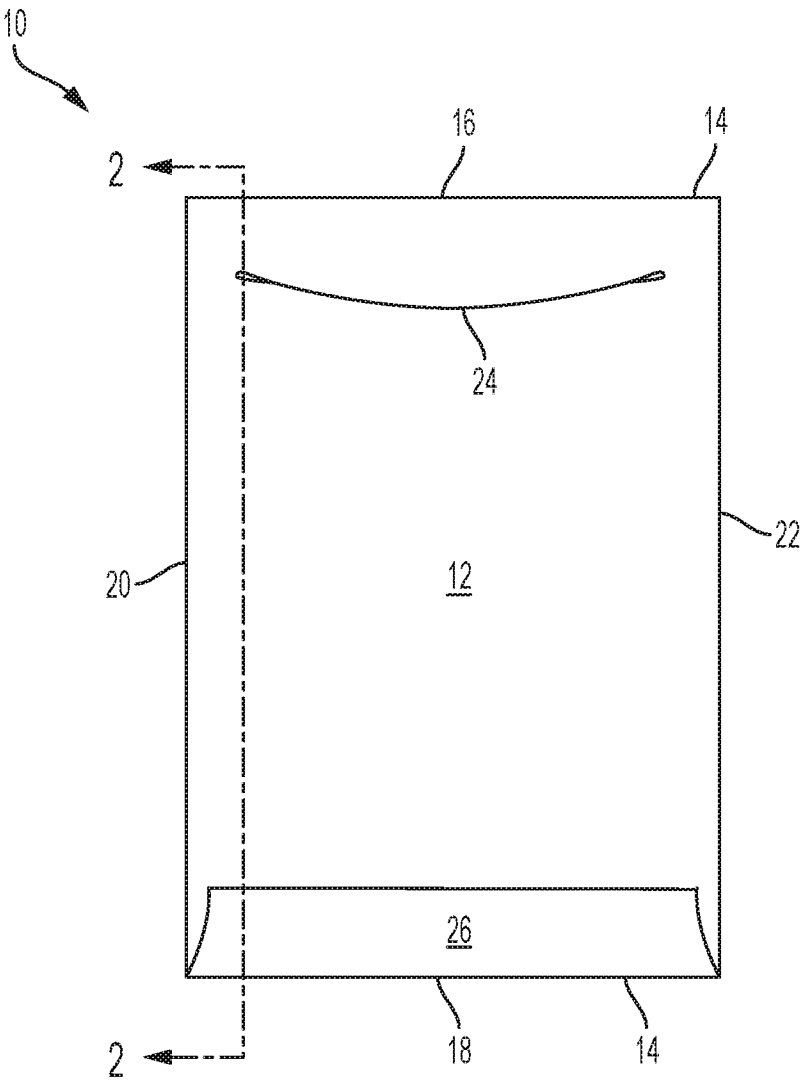
FIG. 1 shows a front plan view of an exemplary lottery ticket holder, according to aspects of the present disclosure.

FIG. 1 shows a front plan view of an exemplary lottery ticket holder 10, adapted for enabling scratching of and easy collection and disposal of coating particles otherwise obscuring information on the lottery ticket according to aspects of the present disclosure. As shown in FIG. 1, the lottery ticket holder 10 may include a substantially planar surface 12 having a perimeter 14 including a plurality of edges—such as but not limited to a top edge 16, a bottom edge 18, a left side edge 20, and a right side edge 22. The top edge 16 may be opposite to the bottom edge 18, and the left side edge 20 may be opposite to the right side edge 22. Although the holder 10 is shown as rectangular in shape, the holder 10—and correspondingly, the surface 12—may be any shape suitable for supporting lottery tickets on the surface 12 and the scratching off of coatings from the lottery tickets. For example, the holder 10 may be square, parallelogramical, trapezoidal, circular, and so on. In preferred embodiments, the surface 12 may be substantially smooth—i.e., free from perceptible projections, lumps, or indentations—for ease using scratching off coatings from lottery tickets placed on the surface 12.

Additionally, the holder 10 may include at least one slot and/or groove 24 disposed along the surface 12 and configured to hold lottery tickets on the surface 12. The term "slot" is generally defined as an elongated aperture or slit in which an object may be inserted. Similarly, the term "groove" is generally defined as an elongated cut or depression, especially one made to guide motion or receive a corresponding "ridge" of an object (such as an edge or corner of a lottery ticket). For purposes of this disclosure, the at least one slot may be synonymous with the at least one groove, and the terms "slot" and "groove" may therefore be used interchangeably. However, for simplicity, the present disclosure will generally use the term "slot" to describe the embodiments.

As shown in FIG. 1, the at least one slot 24 may be disposed along the top edge 16 of the surface 12 and be substantially parallel with the top edge 16. In such embodiments, the slot 24 may be configured to receive and hold a top edge of a lottery ticket. However, different embodiments may include a plurality of slots in any suitable configuration. For example, some embodiments may include four slots disposed along the surface 12, wherein each slot is configured to hold a corner of a rectangular lottery ticket (similar to how business card slots are often configured in a standard two-pocket folder). Yet other embodiments may include two parallel slots disposed diagonally along the surface 12, wherein each slot is configured to an opposite corner of a rectangular lottery ticket. However, there may be benefits to certain slot configurations with respect to accommodating lottery tickets having a wider range of sizes. This is discussed further below.

Additionally, as shown in FIG. 1, the holder 10 also includes a tray 26 attached to the bottom edge 18 of the surface 12. In some embodiments, the tray 26 may extend upward and away from the surface 12 and inward from the perimeter 14. The tray 26 is configured to collect any particulates disposed there within, such as any coatings that may be scratched off of lottery tickets disposed on the surface 12. FIG. 2 shows a cross-sectional side view of the holder 10 taken along lines 2-2 of FIG. 1, according to aspects of the present disclosure. As shown in FIG. 2, the tray 26 may be generally V-shaped or U-shaped in cross section. However, in other embodiments, the tray 26 may be generally L-shaped in cross section, or any other suitable shape for collecting particulates. Additionally, the tray 26 may include one or more sidewalls to aid containment of any particulates disposed there within. However, trays having only one sidewall (or no sidewalls) may provide an added benefit of easier cleaning, such as by allowing a user to simply sweep particulates toward the left side edge 20 or the left right side edge of the surface 12 and out of the tray 26, for example into a garbage receptacle. Such embodiments may also be easier and cheaper to manufacture, and potentially more lightweight and stackable, than embodiments having sidewalls.

In some embodiments, the surface 12, the at least one slot 24, and the tray 26 of the holder 10 may be one continuous piece composed of substantially the same materials. For example, the holder 10 may be composed of one or more plastics commonly used in injection molding and/or additive manufacturing, such as but not limited to acrylonitrile butadiene styrene (ABS), polypropylene, polylactic acid, polyvinyl alcohol, polyoxmethylene (POM), polycarbonate, PVC, nylon 32% glass fiber, acrylic (PMMA), styrene, polyether imide (PEI), acrylonitrile, and/or other mixtures thereof. Additionally or alternatively, the holder 10 may be composed of one or more pure metals, metal alloys, woods, or any other suitable material(s). In some embodiments, the holder 10 may also include at least one high-friction material disposed on the surface and configured to reduce slippage of any lottery tickets thereon. Likewise, the surface 12 may be at least partially coated with rubber, silicone, or the like. Additionally or alternatively, the slot(s) of the holder 10 may be at least partially rubberized to reduce slippage of the lottery ticket there within. In some embodiments, the slot(s) may be composed entirely of a high-friction material or mixture of materials.

Figure 3:
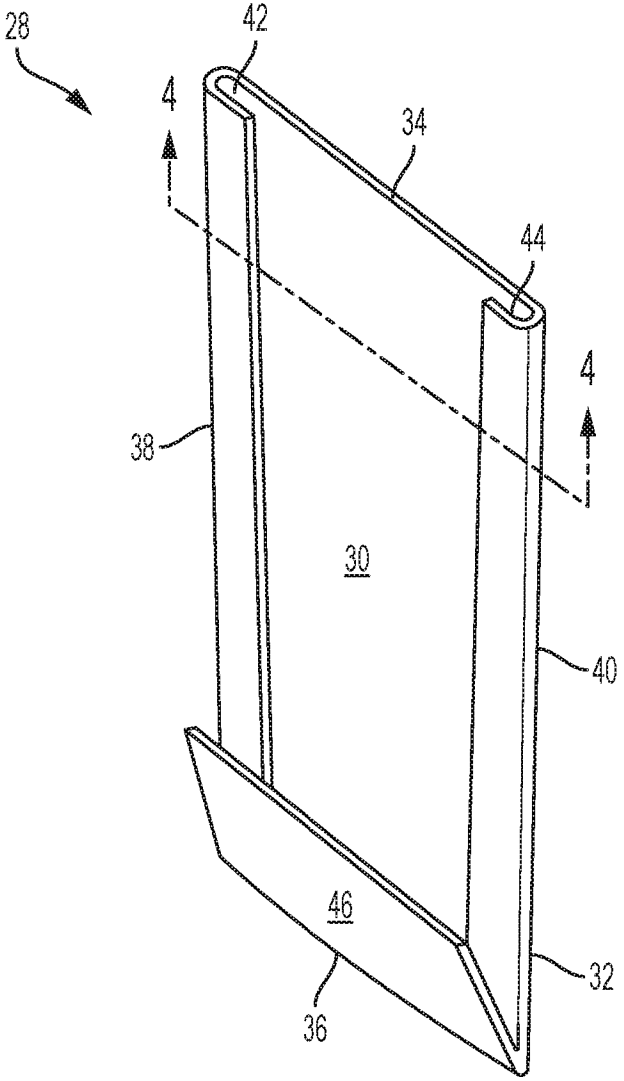
FIG. 3 shows a perspective view of another exemplary lottery ticket holder, according to aspects of the present disclosure.

FIG. 3 shows a perspective view of an exemplary lottery ticket holder 28, according to aspects of the present disclosure. As shown in FIG. 3, the holder 28 may include a substantially flat surface 30 having a perimeter 32 including—for example—a top edge 34, a bottom edge 36, a left side edge 38, and a right side edge 40. As also shown in FIG. 3, the holder 28 may include one or more slots disposed on the surface and configured to collect particulates disposed therein. Specifically, the holder 28 may include a first slot 42 disposed along the left side edge 38 and a second slot 44 disposed along the right side edge 40. As shown in FIG. 3, the first slot 42 may be substantially parallel with the left side edge 38, and the second slot 44 may be substantially parallel with the right side edge 40.

Generally, the slot(s) may extend in any suitable direction along the surface 30, such as longitudinally, transversely, and/or diagonally. Although FIG. 3 shows the slots 42 and 44 as spanning an entire length of the holder 28, other embodiments may include one or more slots that are shorter in length. For example, instead of two slots that span the entire length of the holder, some embodiments may include two slots spaced apart from each other along the left side edge, and another two slots spaced apart from each other along the right side edge—for a total of four slots disposed on the surface.

The embodiment of FIG. 3 may be suitable for accommodating lottery tickets having varied lengths. For example, if standard lottery tickets are four inches wide and up to nine inches long, then it may be desirable for the first slot 42 to be approximately four inches apart from the second slot 44, and for the top edge 34 to be approximately nine inches apart from the bottom edge 36. Such embodiments may thus be suitable for holding lottery tickets having dimensions such as but not limited to 4"×9", 4"×8", 4"×7", and so on. Alternatively, configuring the holder 28 to have a slot disposed near or along the top edge 34 and another slot disposed near or along the bottom edge 36 may provide the benefit of being able to accommodate lottery tickets having varied widths. As an alternative to disposing a slot along the bottom edge 36, some embodiments may use the tray 46 itself as a bottom boundary for a lottery ticket. That is, the bottom edge of the lottery ticket may "sit" inside the tray and thus obviate the necessity for a slot disposed along the bottom edge 36 of the surface 30.

In some embodiments, the holder 28 may accommodate lottery tickets having varying widths. Specifically, a first root of the first slot 42 and a second root of the second slot 44 may be spaced apart from each other at a distance corresponding to a width of a lottery ticket that the holder 28 is configured to hold. The term "root" may generally be defined as the deepest portion of a slot or groove. For example, the slots 42 and 44 may each be one-half inch deep. Accordingly, the slots 42 and 44 may be suitable to hold lottery tickets having widths that vary by approximately one-half inch or less. That is, the holder 28 may be suitable for holding lottery tickets having dimensions such as but not limited to 3.6"×9", 3.8"×7", 4.1"×6", and so on. Different embodiments of the holder 28 may be configured to hold lottery tickets of different sizes.

Figure 4:
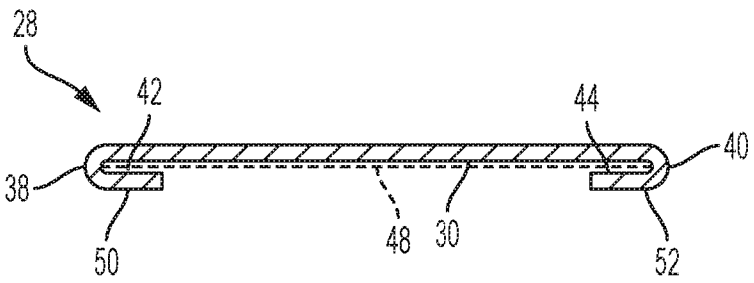
FIG. 4 shows a cross-sectional view of the lottery ticket holder of FIG. 3, including a lottery ticket (as indicated by dotted lines) inserted therein, according to aspects of the present disclosure.

FIG. 4 shows a cross-sectional view of the lottery ticket holder 28 taken along lines 4-4 of FIG. 3, including a lottery ticket 48 (as indicated by the dotted lines) inserted therein, according to aspects of the present disclosure. As shown in FIG. 4, the slots 42 and 44 may hold a lottery ticket 48 on the surface 30. Although FIG. 4 shows only one lottery ticket within the slots 42 and 44, the holder 28 may be configured to hold more than one lottery ticket at a time, depending on how wide the slots 42 and 44 are. For example, wider slots may accommodate a stack of lottery tickets, whereas narrower slots may accommodate only a single lottery ticket at a time.

Additionally, as shown in FIG. 4, some embodiments may include at least one raised portion of the surface 30, on which at least one slot is disposed. In other words, the surface 30 may be substantially but not entirely flat. Specifically, the at least one portion may include a first raised portion 50 disposed on the left side edge 38 and a second raised portion 52 disposed on the right side edge 40. Additionally, the first slot 42 may be a groove disposed along the first raised portion 50 and the second slot 44 may be a groove disposed on the second raised portion 52. However, not all embodiments may include raised portions, such as but not limited to the embodiments shown in FIGS. 1-2. And, other embodiments may use at least one notch instead of at least one slot or groove—notches are discussed further below.

Figure 5:
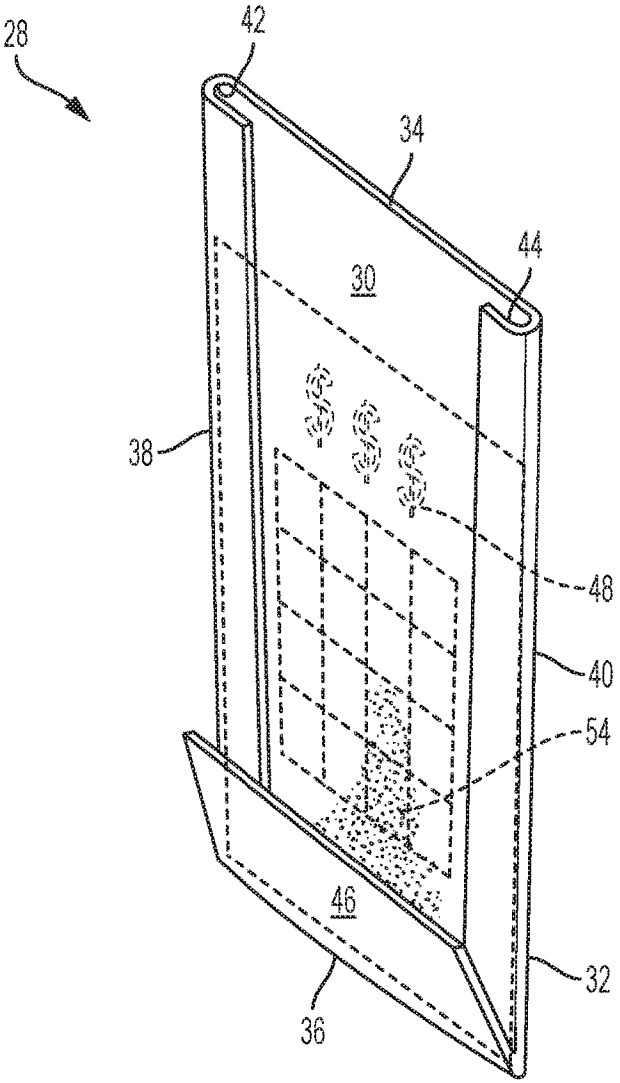
FIG. 5 is a perspective view of the lottery ticket holder of FIGS. 3-4, including the lottery ticket and a coating scratched off therefrom, according to aspects of the present disclosure.

FIG. 5 is a perspective view of the lottery ticket holder of FIGS. 3-4, including the lottery ticket 48 and a coating 54 scratched off therefrom, according to aspects of the present disclosure. In preferred embodiments, the surface 30 may be configured to support the lottery ticket 48 and the scratching off of the coating 54. Accordingly, it may be desirable for the surface 30 to be composed of an at least semi-rigid material or mixture of materials. In some but not all embodiments, the surface 30 may be flexible. Additionally, some embodiments may be non-porous and/or dishwasher-safe to facilitate ease of cleaning with respect to the coating 54 and any other particulates that may be disposed in the tray 46, in the slot(s) 42 and/or 44, or anywhere else on the holder 28.

Furthermore, as shown in FIG. 5, the lottery ticket 48 may be disposed on the surface 30 by inserting the lottery ticket 48 into the slots 42 and 44 at the top edge 34 of the surface. The lottery ticket 48 may then slide along the surface 30 and toward the tray 46, whereupon the tray 46 may serve as a bottom boundary for the lottery ticket 48. The lottery ticket 48 may be removable from the holder 28 by sliding the lottery ticket 48 back toward the top edge 34 and out from the slots 42 and 44. Alternatively, the lottery ticket 48 may be disposed on the surface 30 by slightly bending the lottery ticket 48 and inserting the sides of the lottery ticket into the slots 42 and 44, lengthwise. The lottery ticket 48 may then be flattened to be flush against the surface 30, once its sides are inserted into the slots 42 and 44. An example of how this may be achieved is shown in FIG. 6.

Figure 6:
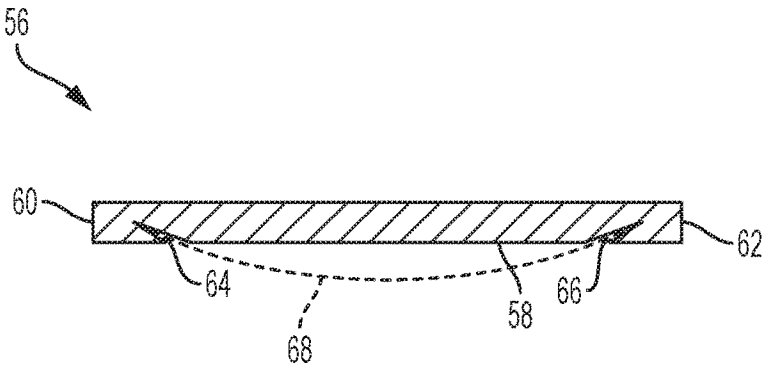
FIG. 6 shows a cross-sectional view of another exemplary lottery ticket holder, according to aspects of the present disclosure.

FIG. 6 shows a cross-sectional view of another exemplary lottery ticket holder 56 (taken of a lottery holder from a similar perspective to the cross section of FIG. 4), according to aspects of the present disclosure. As shown in FIG. 6, the holder 56 may include a substantially flat surface 58 having a left side edge 60 opposite to a right side edge 62. The holder 56 may also include at least one notch—as opposed to at least one slot or groove—disposed on the surface 58. The term "notch" may generally be defined as an indentation, incision, or V-shaped cut in a surface. Accordingly, it may not be necessary for the surface 58 to have any raised portions on which a slot or notch is disposed.

Specifically, the holder 56 may include a first notch 64 disposed, or located, near the left side edge 60 and a second notch 66 disposed along the right side edge 62. Like the slot(s) and/or groove(s) of other embodiments, the notches 64 and 66 may be configured to hold a lottery ticket 68 on the surface 58. The lottery ticket 68 is shown as slightly bent, or curved, and may be flattened to be flush against the surface 58 and more fully inserted into the slots 64 and 66. Embodiments may include any suitable mixture of slots, grooves, and/or notches. In fact, some embodiments may include one or more series of slots, grooves, and/or notches so that the lottery ticket holder may be "one size fits all" by accommodating various sizes of lottery tickets.

Advantages, Features, Benefits

The different embodiments of lottery ticket holders described herein may provide several advantages over previous systems. For example, the illustrative embodiments described herein provide a simple, lightweight, and portable solution for supporting the scratching off of coatings from lottery tickets, as well for collecting the scratched-off coatings.

Additionally, and among other benefits, illustrative embodiments described herein allow for relatively low manufacturing costs and assembly lead times, depending on the material(s) from which the holders are formed. The disclosed embodiments offer significant advantages over conventional systems because they may be mass manufactured through injection molding and/or 3D printing, in addition to conventional manufacturing methods. Furthermore, certain embodiments may be slim and stackable, thereby allowing opportunities for retailers to sell the disclosed holders in lottery ticket vending kiosks. No known systems can produce these results, particularly bulky systems having multiple and/or moving parts.

Thus, the illustrative embodiments described herein are particularly useful for the scratching of lottery tickets in locations where no other suitable structure (e.g., a desk, table, countertop, platform, or similar) may be available. However, not all embodiments described herein provide the same advantages or the same degree of advantage.

Conclusion

The disclosure set forth above may encompass multiple distinct inventions with independent utility. Although each of these inventions has been disclosed in its preferred form(s), the specific embodiments thereof as disclosed and illustrated herein are not to be considered in a limiting sense, because numerous variations are possible. To the extent that section headings are used within this disclosure, such headings are for organizational purposes only, and do not constitute a characterization of any claimed invention. The subject matter of the invention(s) includes all novel and nonobvious combinations and subcombinations of the various elements, features, functions, and/or properties disclosed herein. The following claims particularly point out certain combinations and subcombinations regarded as novel and nonobvious. Invention(s) embodied in other combinations and subcombinations of features, functions, elements, and/or properties may be claimed in applications claiming priority from this or a related application.

What is claimed is:

1. A portable lottery ticket holder, comprising:

a substantially planar surface having a perimeter including a top edge, a bottom edge, a left side edge, and a right side edge, the top edge being opposite to the bottom edge, and the left side edge being opposite to the right side edge;

at least one slot disposed along the planar surface and configured to hold a lottery ticket on the surface; wherein the at least one slot includes a first slot disposed along the left side edge and a second slot disposed along the right side edge of the planar surface;

a high-friction material disposed along at least a portion of the slot and configured to reduce slippage of the lottery ticket within the slot; and an open-ended tray that is substantially v-shaped in cross-section and attached to the bottom edge of the planar surface, the open-ended tray being configured to collect particulates disposed within the open-ended tray.

2. The lottery ticket holder according to claim 1, wherein the planar surface is configured to support the scratching off of a coating from the lottery ticket.

3. The lottery ticket holder according to claim 1, wherein the at least one slot further comprises a third slot disposed along the top edge of the planar surface.

4. The lottery ticket holder according to claim 1, wherein the first slot and the second slot are configured to enable the lottery ticket to slide longitudinally onto the planar surface and toward the open-ended tray.

5. The lottery ticket holder according to claim 4, wherein a first root of the first slot is spaced apart from a second root of the second slot at a distance corresponding to a width of the lottery ticket.

6. The lottery ticket holder according to claim 4, wherein the first slot is substantially parallel from the left side edge and the second slot is substantially parallel with the right side edge.

7. The lottery ticket holder according to claim 1, further comprising at least one raised portion of the planar surface, on which the at least one slot is disposed.

8. The lottery ticket holder according to claim 7, wherein the at least one raised portion includes a first raised portion disposed on the left side edge and a second raised portion disposed on the right side edge.

9. The lottery ticket holder according to claim 8, wherein the first slot is a groove disposed along the first raised portion and the second slot is a groove disposed along the second raised portion.

10. The lottery ticket holder according to claim 1, further comprising at least one high-friction material disposed on the planar surface and configured to reduce slippage of the lottery ticket on the planar surface.

11. The lottery ticket holder according to claim 1, wherein the open-ended tray extends upward and away from the planar surface and inward from the perimeter.

12. The lottery ticket holder according to claim 1, wherein the planar surface, the at least one slot, and the open-ended tray form one continuous piece composed of substantially the same materials.

13. The lottery ticket holder according to claim 1, wherein the tray is stackable with a second tray of a second lottery ticket holder.

14. A lottery ticket holder adapted for enabling scratching of a lottery ticket, comprising:

a substantially flat surface having a perimeter including a top edge, a bottom edge, a left side edge, and a right side edge, the top edge being opposite to the bottom edge, and the left side edge being opposite to the right side edge;

at least one notch disposed on the flat surface and configured to hold a lottery ticket ticket on the surface; wherein the at least one notch includes a first notch disposed near the left side edge and a second notch disposed near the right side edge;

a high-friction coating disposed along at least a portion of the notch and configured to reduce slippage of the lottery ticket within the notch; and a substantially v-shaped tray disposed along the bottom edge of the flat surface and configured to collect particulates disposed within the tray.

15. The lottery ticket holder according to claim 14, wherein the v-shaped tray has a plurality of openings from which the particulates are removable, including a top opening, right-side opening, and a left-side opening.

16. The lottery ticket holder according to claim 14, wherein the high-friction material is rubber.

17. The lottery ticket holder according to claim 14, wherein the lottery ticket holder is manufactured by additive printing.

* * * * *